United States Patent [19]

Lauber

[11] Patent Number: 5,003,873

[45] Date of Patent: Apr. 2, 1991

[54] FLEXOGRAPHIC PRINTING MACHINE, ESPECIALLY FOR FLEXOGRAPHIC BLANK PRINTING

[75] Inventor: Peter Lauber, Stetten, Switzerland

[73] Assignee: Conprinta Ltd., Zurich, Switzerland

[21] Appl. No.: 428,050

[22] Filed: Oct. 27, 1989

Related U.S. Application Data

[63] Continuation of Ser. No. 189,537, May 3, 1988, abandoned.

[30] Foreign Application Priority Data

May 7, 1989 [CH] Switzerland ..... 01741/87

[51] Int. Cl.[5] ..... B41F 5/04; B41F 31/30

[52] U.S. Cl. ..... 101/219; 101/352

[58] Field of Search ..... 101/349, 350, 351-352, 101/207-210, 228, DIG. 48, 148, 216, 219, 248

[56] References Cited

U.S. PATENT DOCUMENTS 4,370,926 2/1983 Hattori ..... 101/352

4,528,907 7/1985 Davison ..... 101/352

FOREIGN PATENT DOCUMENTS 1140205 11/1962 Fed. Rep. of Germany ..... 101/206

*Primary Examiner*—J. Reed Fisher

*Attorney, Agent, or Firm*—Bachman & LaPointe

[57] ABSTRACT

A flexographic printing machine, especially for flexographic web printing, has at least one printing unit. The printing unit comprises a printing cylinder or an endless printing belt drawn on round a back-up cylinder and a tension roller, an impression cylinder, an engraved roller for transferring the ink to the printing cylinder or to the printing belt, and an ink drier. A paper web runs through all the printing units. Incorporated in each printing unit is a working engraved roller, which can be uncoupled from a drive shaft of the flexographic printing machine during the operation of the latter, and at least one stand-by engraved roller which can be connected automatically in exchange during the set-up time.

8 Claims, 5 Drawing Sheets

FLEXOGRAPHIC PRINTING MACHINE, ESPECIALLY FOR FLEXOGRAPHIC BLANK PRINTING

This is a continuation, of application Ser. No. 189,537 filed May 3, 1988, now abandoned.

BACKGROUND OF THE INVENTION

The invention relates to a flexographic printing machine, especially for flexographic web printing, which comprises at least one printing unit, each with a printing cylinder or an endless printing belt drawn on round a back-up cylinder and a tension roller, with an impression cylinder, with an engraved roller transferring the ink to the printing cylinder or to the printing belt, and with an ink drier, and a paper web running through all the printing units and guided via an idler roller or idler rollers and a draw roller or draw rollers between the printing cylinder or printing belt and the impression cylinder and through the ink drier.

In conventional flexographic printing machines, a printing cylinder is used as a plate carrier or rubber cylinders with a structured surface are used. The disadvantage of these printing cylinders carrying the negative printing pattern on their surface is that they have to be exchanged for each printing order. U.S. Pat. No. 3,518,940 therefore proposes a printing mechanism comprising an endless belt composed of polyethylene terephthalate, on which the flexible printing plates are mounted.

Messrs. Conprinta Ltd., Zurich, further developed the flexographic printing machines with an endless printing belt and described these in their prospectus "Flexographic Printing Presses". The basic principle of these flexographic printing machines is illustrated in FIGS. 1 and 2 which represent prior art. A dimensionally stable endless belt 11 is drawn onto a back-up cylinder 12 and a tension roller 14. Flexible printing plates 16 are fastened to the outer face of this endless belt, thus forming a printing belt 10. The printing ink is transferred to the printing plates 16 from an engraved roller 18 which dips into an ink bath (not shown). Excess ink is scraped off by a doctor blade 20 designed in the form of a negative angle. The paper web 22 guided in the direction of the arrow is pressed onto the printing plates by an impression cylinder 24 and printed on one side.

An optionally mountable short endless belt 11' having only a few printing plates 16' and tensioned by a tension roller 14' is represented by broken lines.

FIG. 2 shows a cut-out from the printing belt 10. The endless belt 11 serving as a carrier consists of a polyester film, for example approximately 0.25 mm thick, especially polyethylene terephthalate. The physical properties of the transversely and longitudinally stretched film material are the same in all directions. The uniformity extends over a wide temperature and humidity range. Furthermore, the film-like belt material has good elongation and high impact resistance in transverse and longitudinal directions. Finally, the flexible film material of the endless belt is chemically resistant and withstands oils, greases, printing inks, etc. The longitudinal sides of the endless belt 11 are provided with a perforation 26, through which engage knobs of the spiked disks transporting the belt in a known way. The printing belt can thus be prevented from sliding on the rollers.

The flexible printing plates 16 conventionally consist of a photopolymer material or rubber and are glued to the endless belt 11 by means of a suitable adhesive. In the present example, the printing plates 16 have a structured surface 28 which produces the printing pattern.

The advantage of the above-described printing belt 10 is that the flexible printing plates 16 do not have to be mounted on a printing cylinder, but can be glued to the endless belt which is easily removed from the flexographic printing machine after use. All the printing belts used can be rolled onto a tube and stored in a space-saving way.

At present, flexographic prints of a width up to 2.5 m are produced by means of printing belts of a length of up to 4.5 m. The flexographic printing machines work at high speed and are equipped with checking instruments for the automatic monitoring and recording of the paper webs.

Flexographic printing machines constructed according to the Conprinta System are conventionally equipped with 3 to 10 printing units. Any printing unit not participating in the current printing process can be equipped for the next working step during that available idle time. During this, the printing belt no longer used is removed, the new printing belt is fitted and the printing ink is exchanged. This usually takes 5 to 15 minutes.

Of course, instead of the printing belt, individual printing units can also contain a conventional structured or non-structured printing cylinder. This applies primarily to smooth or structured lacquerings or to the application of a base color.

The inventor made it his object to improve further a flexographic printing machine of the type mentioned in the introduction and make its mode of operation more efficient. In particular, an engraved roller with the best possible screen should be available for each printing, without the need for assembly work which involves a high outlay and which is detrimental to the operating time of the machine.

SUMMARY OF THE INVENTION

According to the invention, the foregoing object is achieved because incorporated in each printing unit is a working engraved roller, which can be uncoupled from the drive shaft of the flexographic printing machine during the operation of the latter, and at least one stand-by engraved roller which can be connected automatically in exchange during the set-up time of the printing unit.

At the appropriate moment, the additional automatically connectable engraved roller or rollers can be substituted for the working engraved roller in a fraction of the time necessary hitherto. Appropriately, the stand-by roller or stand-by rollers have a different screen from that of the working roller. A person skilled in the art knows that different engraved rollers are preferably used for different printing motifs (surface printing, engraved printing). When a change of order is imminent, the engraved roller with the screen value and/or scoop-up capacity for the ink transfer which correspond to the printing motif can be connected in exchange on a free printing unit during the normal set-up time, without interrupting the operation of the remaining printing installation. The scoop-up capacity of an engraved roller is dependent on the width and depth of the recesses.

The working engraved roller and the stand-by engraved roller or rollers are preferably mounted in two pivoting arms which are located on the end faces and which are fastened to the machine housing or machine frame or each in a lifting slide. After a position stop has been cancelled, these pivoting arms can be rotated about one continuous axle or two axles arranged in the region of the pivoted arms. After rotation, another engraved roller is in the working position and is fixed by means of a position stop. The engraved roller no longer required can now be cleaned or removed, without the printing process having to be interrupted.

It has been shown, in practice, that a three-roller system is less advantageous than a two-roller system. This is mainly because the stand-by engraved roller can be exchanged without much outlay during the operation of the flexographic printing machine, and because there are usually other printing units available when another screen is needed. Systems with two engraved rollers are therefore more economical to operate and technically simpler to put into effect.

Preferably, the working engraved roller and the stand-by engraved roller are mounted on both sides of the axle or axles on two straight pivoting arms. These pivoting arms are rotatable through at least 180°, and an engraved roller is rotated through this angle from the working position into the stand-by position or vice versa.

Before the pivoting arms are rotated, pieces of equipment of the flexographic printing machine obstructing this movement are displaced automatically, for example the ink bath with the doctor blade and, if appropriate, the tension roller when a printing belt is used. The printing machine is designed so that these steps can be carried out simply.

The pivoting movement is prevented from being impeded if the pivoting arms with the axle or axles for the engraved rollers can be lowered, with the working roller at the top, or raised, with the working roller at the bottom. Appropriately, the system moves out of a position stop simultaneously with the lowering or raising operation and can be pivoted only after this movement has been executed.

The flexographic printing machine can be equipped with means which, because of the position stop, ensure a delayed automatic rotation of the pivoting arms together with the axle or axles for the engraved rollers. This can be achieved, for example, by fitting racks and equipping the engraved rollers with rigidly arranged gear wheels. The gear wheels engage into the teeth only when the system has moved out of the position stop.

It should be possible, when required, for the engraved rollers mounted rotatably in the pivoting arms to be removed easily when they are on stand-by. Preferably, therefore, the bearing journals of the engraved rollers can be exposed by lifting off caps screwable onto the pivoting arms. Depending on the design of the flexographic printing machine, the engraved rollers to be replaced can be lowered onto a trolley or lifted off by means of a crane.

The pivoting arms fastened to the machine frame or machine housing or in the lifting slide are driven on both sides of the end faces of the engraved rollers. The rotary movement usually covering 180° is preferably executed by means of synchronized electric, pneumatic or hydraulic motors arranged on both sides of the common axle. Where possible on geometrical grounds, the rotary movement can be executed by means of only one motor and one shaft extending from one machine frame to the other. However, if the pivoting arms are arranged in a straight line, this necessitates a greater distance between the engraved rollers, as a result of which the pieces of equipment obstructing a rotary movement of the pivoting arms have to be moved further away. In practice, therefore, synchronized motors arranged on both sides are usually used.

According to another alternative form, a stand-by engraved roller can be connected automatically in exchange by means of shifting guides. However, this system is more expensive and more complicated than the above-described rotary movements of the pivoting arms.

A feature common to all the embodiments of the invention is that the stand-by engraved roller or rollers can be removed or installed during the printing operation. This makes it possible for interruptions in operation to be very short when the printed motif is changed, particularly if printing belts are used instead of printing cylinders.

BRIEF DESCRIPTION OF THE DRAWINGS

The invention is explained in detail with reference to exemplary embodiments illustrated in the following functional schematic drawing.

DETAILED DESCRIPTION

Figure 1:
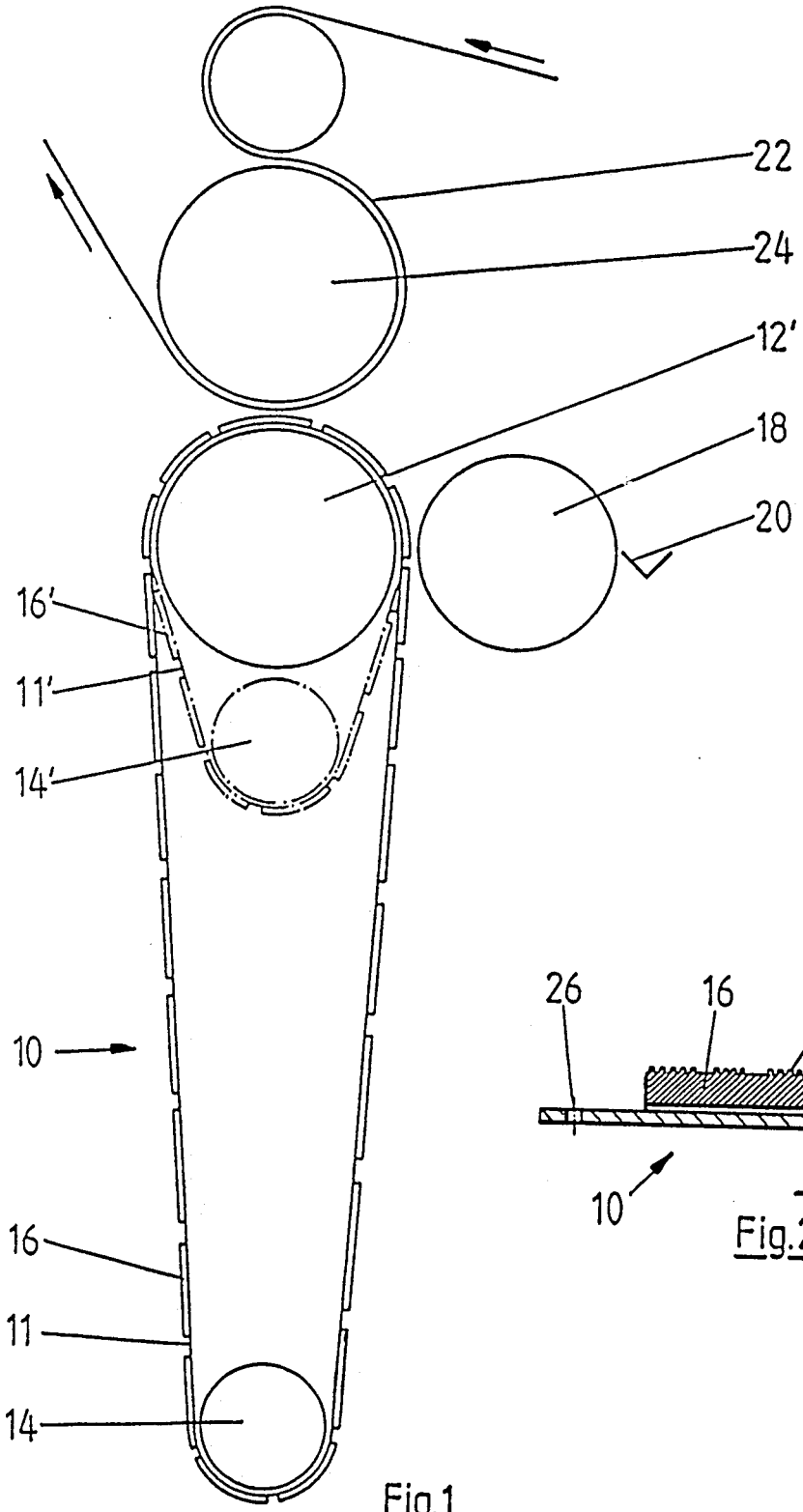
Fig.1 PRIOR ART
FIGS. 1 and 2 are schematic illustrations of a prior art printing machine.
Figure 2:
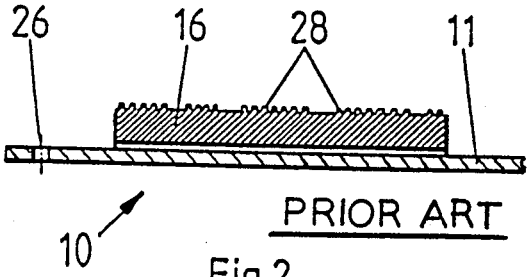
PRIOR ART Fig.2
Figure 3:
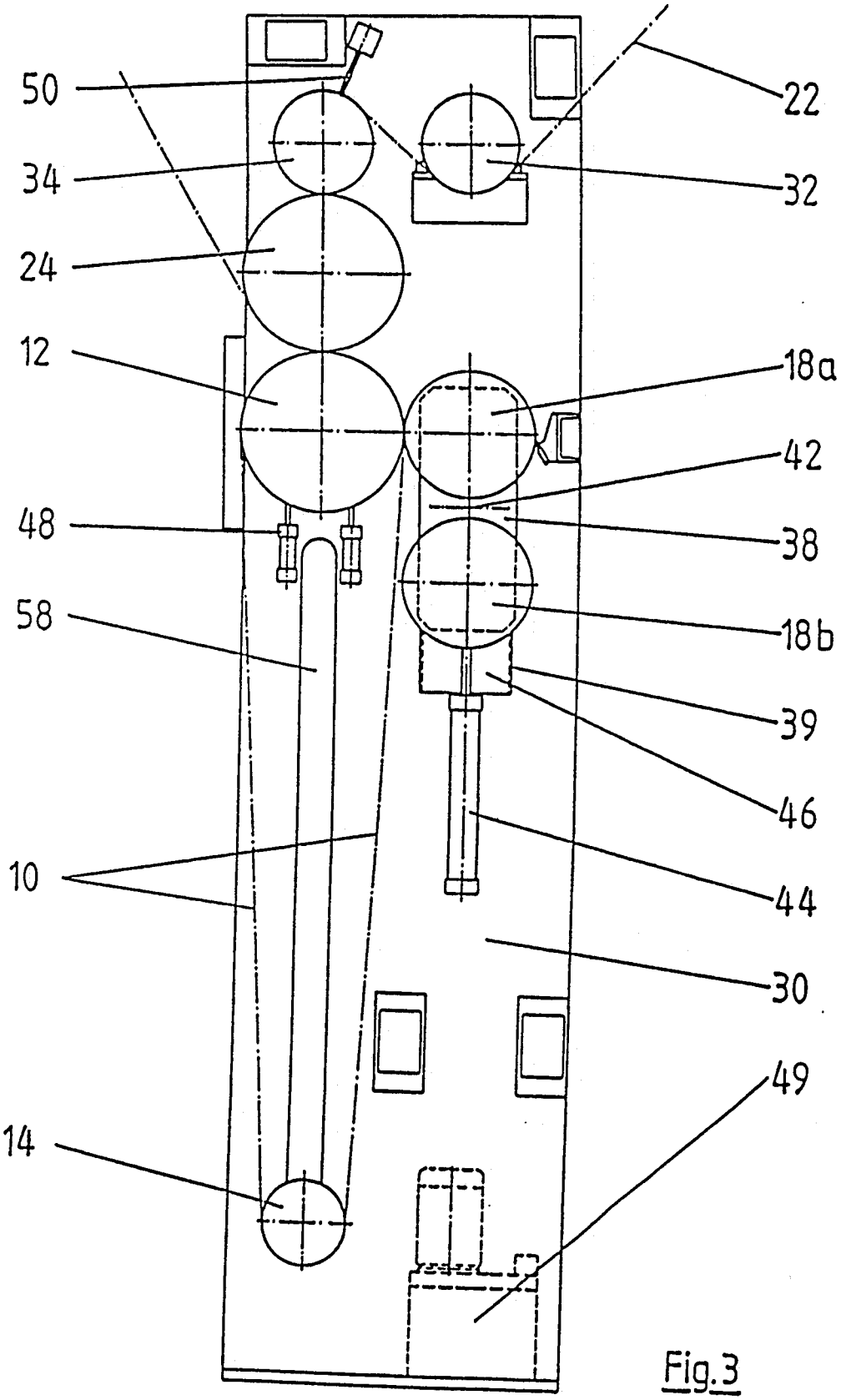
FIG. 3 shows a side view of a flexographic printing unit with engraved rollers pivotable from one position into the other.
Figure 4:
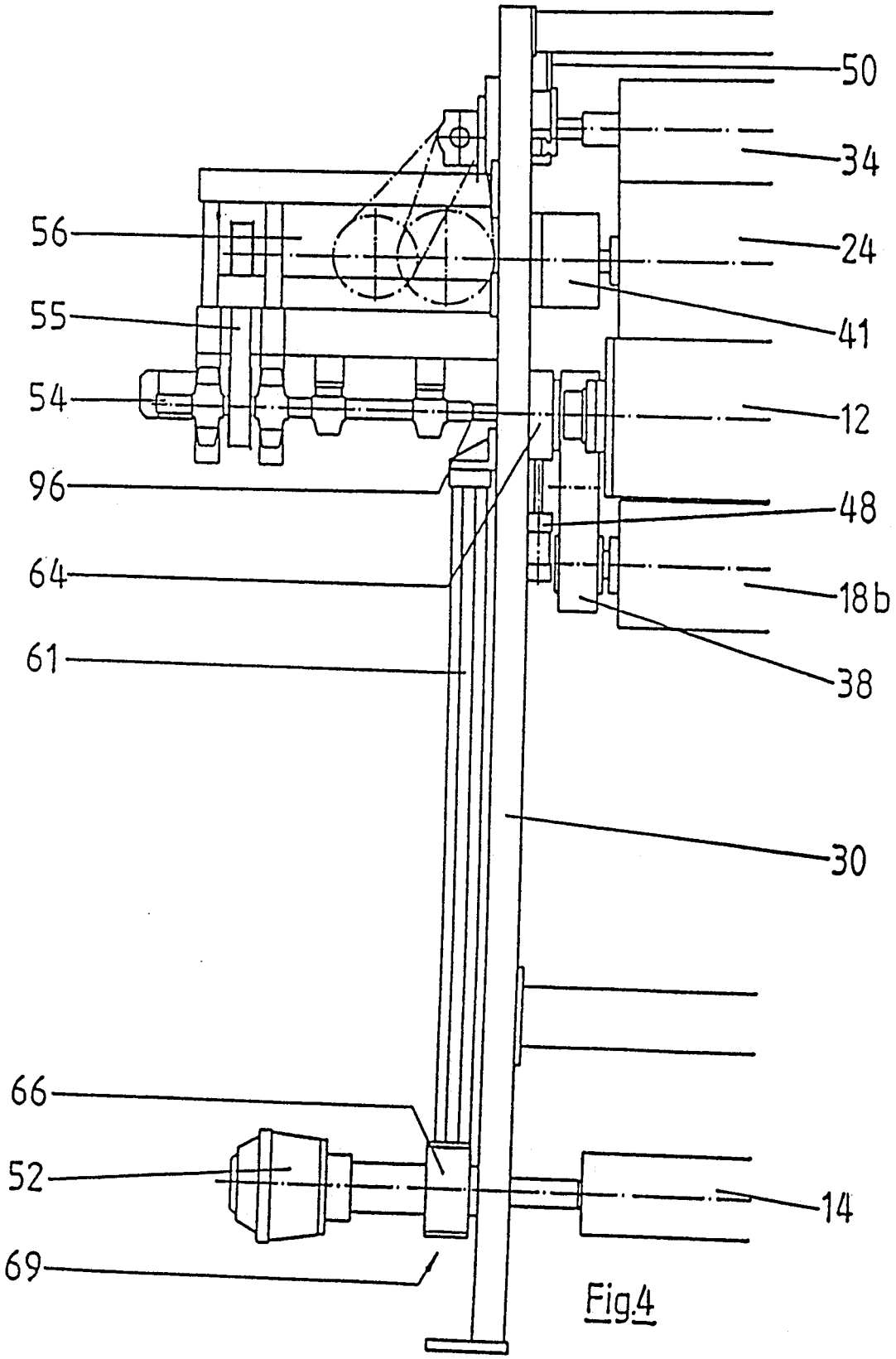
FIG. 4 shows a part view of FIG. 3 from the left.

The printing unit of a flexographic printing machine, illustrated in FIGS. 3 and 4, contains a machine frame 30 with the rollers and cylinders guiding and printing a paper web 22, their suspensions and their drive members, attention being drawn to FIGS. 1 and 2. The constructional parts corresponding to the state of the art are not all shown and described in detail.

The paper web 22 is guided via an idler roller 32 to the rubberized draw roller 34. The paper web 22 loops round the impression cylinder 24 after the draw roller 34 and, when it passes through between the back-up cylinder 12 and impression cylinder 24, is printed with the ink transferred from the working engraved roller **18*a* to the printing belt 10**.

Figure 5:
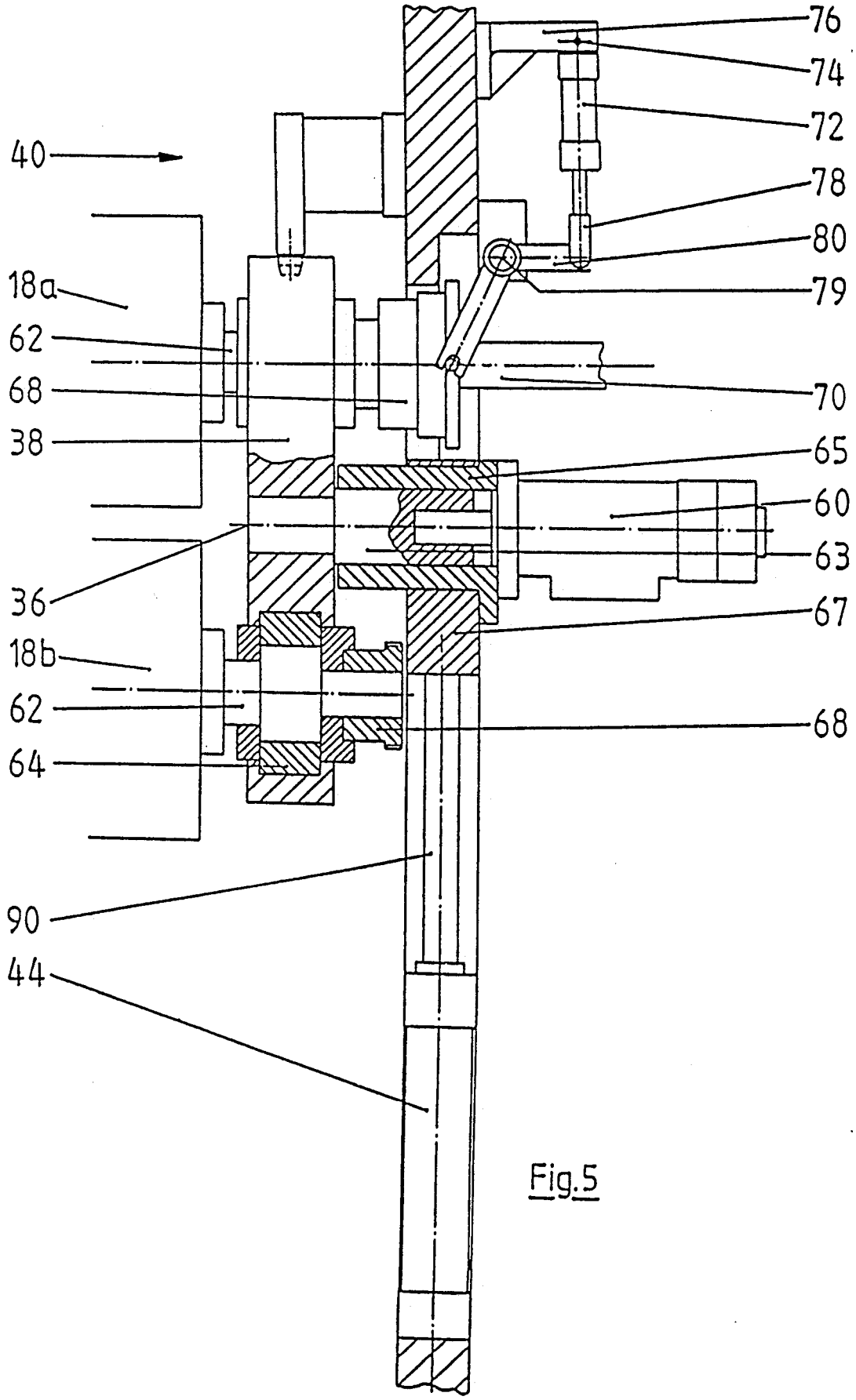
FIG. 5 shows a partially cutaway part view of pivotable engraved rollers with associated components.
Figure 6:
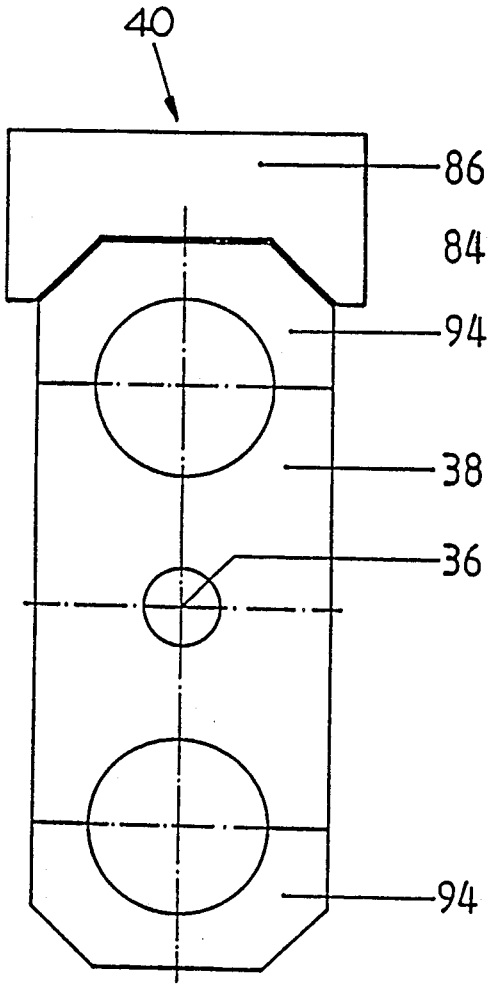
FIGS. 6, 7 show two alternative forms of the position stop formed according to FIG. 5.
Figure 7:
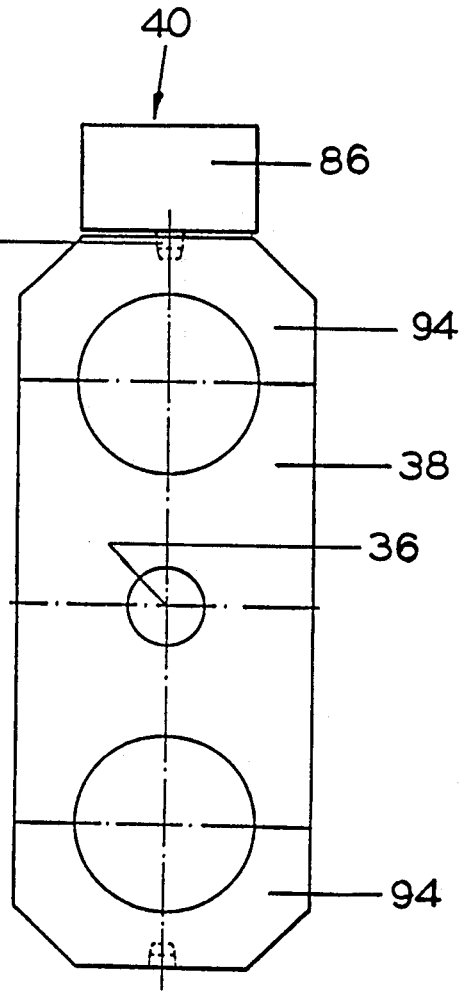

The working engraved roller **18*a* and the stand-by engraved roller 18*b* are mounted on two pivoting arms 38 which are located on the end faces of the engraved rollers and which, mounted in mutually opposite side spars of the machine frame 30, are each rotatable about a central pivot axle 36 (FIGS. 5, 6, 7). When the extended pivoting arm rotates through 180°, the working engraved roller consequently becomes the stand-by engraved roller, and vice versa. The positioning devices 40 (FIGS. 5, 6, 7) guarantee a stable retention of the engraved roller 18*a*** in the working position.

The lifting cylinders 44 fastened to the machine frame 30 on both sides and having respective lowerable protective housings 46 arranged directly above them and themselves each guiding a piston rod (not shown) supporting the pivoting arm 38 allow the pivoting arm 38 and consequently the two engraved rollers **18*a*, 18*b* to be lowered as far as a stop. At the same time, the upper part of the pivoting arm 38 moves out of the position stops 40 on a rail guide 39** and can now be rotated through 180° by means of a device exerting a torque.

After the operation of lifting and simultaneous engagement in the position stops 40, the engraved roller previously on stand-by becomes the new working engraved roller 18*a*.

The hydraulic lifting cylinders 48 serve for positioning the back-up cylinder 12 and the hydraulic pressure cylinders 50 for positioning the draw roller 34. The hydraulic unit 49 is indicated in FIG. 3.

The drive units 52 for the tension roller 14, 54 for the back-up cylinder 12 and 56 for the impression cylinder 24 are of a conventional design familiar to a person skilled in the art, as are the appropriately telescopically extendable spindles or shafts for transmitting the torques to the corresponding rollers. According to FIG. 4, the unit 54 does not exert its own drive force, but obtains this via a transmission means. The unit 54 drives the back-up cylinder 12 via a cardan shaft 96 which can absorb movements in all directions.

The unit 56 for the impression cylinder 24 is driven via a timing belt 55, this unit also driving the draw roller 34, as indicated by dot-and-dash lines in FIG. 4.

The printing belt 10 and the paper web 22 are driven separately, but they must always run at exactly the same speed. Whenever the relative speed changes, the pull on the printing belt is varied by rotating the tension roller somewhat more quickly or more slowly. An additional or a lower torque is thus exerted on the printing belt.

The tension roller 14 is suspended via a spindle lifting system 69. As shown in FIG. 4, the height of the tension roller 14 is varied as a result of the rotation of the threaded spindle 61 which engages through the tension-roller bearing 66.

According to an alternative form (not shown), the printing belt 10 and the tension roller 14, together with the tension linkage, are omitted and the back-up cylinder 12 is designed as a printing cylinder. Such alternative forms of the printing unit are suitable, above all, for base coatings and smooth or structured lacquerings.

FIG. 5 shows in detail a system of the rotatable engraved rollers 18*a*, 18*b*. The pivot axle 36 for the pivoting arm 38 together with the two engraved rollers merges in the direction of the machine frame into a journal 63 which is connected rigidly to the pivoting arm 38 and which itself is mounted rotatably in a sleeve-shaped retention means 65. This retention means 65 is anchored in a lifting slide 67 and also carries the flanged-on rotary cylinder 60 which is driven by the hydraulic unit 49 shown in FIG. 3. The drive shaft of the rotary cylinder 60 transmits the drive force to the journal 63.

On the opposite end face of each of the two engraved rollers 18*a*, 18*b*, there is a corresponding pivoting arm with bearings for the engraved rollers and synchronized means for the drive.

The bearing journals 62 of the two engraved rollers 18*a*, 18*b* are arranged in the straight pivoting arm 38 via bearings 64. The roller drive, for example an electric servo-motor, extends coaxially relative to the engraved roller 18*a*. According to choice, the roller drive takes place directly from the main drive, for example by means of a toothed belt.

A coupling 68 of known design makes it possible to separate the roller journal 62 from the drive shaft 70 of the roller drive. The coupling 68 is actuated by a hydraulic cylinder 72 which is supported on a holder 76 via a cylindrical pin 74. The hydraulic cylinder 72 transmits its force to the coupling 68 via a fork joint 78 and an angled lever 80 pivotable about an axle 79. In the present example, the coupling is designed as a toothed-quadrant coupling.

The hydraulic lifting cylinder 44 makes it possible, by means of the piston rod 90, to lower the lifting slide 67 together with the pivoting arm 38 for the two engraved rollers 18*a*, 18*b* as far as a stop. This is necessary in order to obtain the free space required for the rotation of the engraved rollers.

Two alternative forms of the positioning device 40 for stopping the pivoting arm 38 in the working position are shown in stylized form in FIGS. 6, 7.

In FIG. 6, the position stop 86 is designed with a groove of trapezoidal cross-section on the underside. The caps 94 screwed to the end faces of the pivoting arm 38 are designed to match the above mentioned groove of trapezoidal cross-section. When the pivoting arm 38 together with the pivot axle 36 for the engraved rollers is raised, it is centered automatically in the position stop.

In FIG. 7, the position stop serving the same purpose and being rectangular in cross-section has a peg 84. Corresponding recesses are made in the caps 34 as a bore, longitudinal slot or groove, into which the peg 84 can engage. The peg can be dome-shaped and in the working position engage with a correspondingly designed bearing shell.

While the upper engraved roller 18*a* (FIG. 5) is working, the lower cap 94 can be unscrewed and the lower engraved roller 18*b* (FIG. 5) exchanged.

The flexographic printing machine according to the invention is especially suitable for producing large-surface multicolor prints. The resulting flexographic printing process is therefore also extremely economical. In flexographic web printing, a paper web used as a cover sheet is printed for cardboard packaging.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A printing machine for flexographic web printing comprises at least one printing unit, each of said at least one printing unit being provided with a back-up cylinder, a tension roller and an endless printing belt drawn around said back-up cylinder and said tension roller, an impression cylinder for pressing said web against said back-up cylinder, an ink bath, a first engraved roller and a second engraved roller for transferring ink to said endless printing belt, drive means for drawing said web between said back-up cylinder and said impression cylinder for printing said web with ink transferred from said endless printing belt and positioning means for selectively positioning said first engraved roller and said second engraved roller between a first position wherein said first engraved roller is a working engraved roller positioned so as to pick up ink from said ink bath for transferring ink to said endless printing belt and said second engraved roller is a stand-by engraved roller and a second position wherein said second engraved roller assumes the position of said first engraved roller when in said first position and is the working engraved roller for picking up ink from said ink bath for transferring ink to said endless printing belt and said first engraved roller assumes the position of said second engraved roller when in said first position.

2. A printing machine according to claim 1 wherein said first engraved roller and said second engraved roller have different screen values.

3. A printing machine according to claim 1 wherein said first engraved roller and said second engraved roller have different scoop-up capacities for ink transfer.

4. A printing machine according to claim 1 wherein said positioning means includes a pair of spaced apart pivotable arms rotatably mounted on said machine about an axis and said first engraved roller and said second engraved roller extend between said arms and are mounted on bearings carried by said arms.

5. A printing machine according to claim 4 wherein said positioning means further includes first motor means for rotating said arms so as to selectively position said engraved rollers between said first position and said second position.

6. A printing machine according to claim 5 wherein said positioning means further includes second motor means for raising and lowering the pair of arms and therewith the engraved rollers.

7. A printing machine according to claim 1 including coupling means for selectively coupling a respective one of said engraved rollers to said drive means when said respective one is the working engraved roller.

8. A printing machine according to claim 4 wherein a respective one said engraved rollers can be removed from said pair of arms when said respective one is not the working engraved roller.

* * * * *